United States Patent [19]

Nishiyama et al.

[11] 3,966,141

[45] June 29, 1976

[54] APPARATUS FOR PROCESSING YARN END OF COPS SUPPLIED TO THE WINDER

[75] Inventors: Shigeyuki Nishiyama, Amagasaki; Kotaro Tsurumi, Takatsuki; Katsuaki Yoshimura, Amagasaki, all of Japan

[73] Assignee: Nihon Spindle Seizo Kabushiki Kaisha, Tokyo, Japan

[22] Filed: Oct. 17, 1973

[21] Appl. No.: 407,349

[30] Foreign Application Priority Data

| | | |
|---|---|---|
| Oct. 17, 1972 | Japan | 47-104117 |
| Oct. 17, 1972 | Japan | 47-104118 |
| Nov. 28, 1972 | Japan | 47-119618 |
| Mar. 13, 1973 | Japan | 48-31591[U] |

[52] U.S. Cl. ..... 242/35.5 A; 242/35.6 E

[51] Int. Cl.[2] ..... B65H 54/26

[58] Field of Search ..... 242/35.5 R, 35.5 A, 242/35.6 R, 35.6 E

[56] References Cited

UNITED STATES PATENTS

| | | | |
|---|---|---|---|
| 2,010,465 | 8/1935 | Reiners et al. | 242/35.5 A |
| 2,052,895 | 9/1936 | Reiners et al. | 242/35.5 R |
| 2,177,763 | 10/1939 | Abbott et al. | 242/35.6 R |
| 2,208,930 | 7/1940 | Kahlisch | 242/35.6 R |
| 2,350,927 | 6/1944 | Reiners et al. | 242/35.5 A |
| 3,224,694 | 12/1965 | Oishi | 242/35.5 R |
| 3,279,710 | 10/1966 | Raasch | 242/35.5 R |
| 3,381,908 | 5/1968 | Igushi et al. | 242/35.5 R |
| 3,421,705 | 1/1969 | Benedict | 242/35.5 R |
| 3,506,209 | 4/1970 | Matsui et al. | 242/35.5 R |
| 3,774,859 | 11/1973 | Brouwer et al. | 242/35.5 R |

*Primary Examiner*—Stanley N. Gilreath

*Attorney, Agent, or Firm*—Blum, Moscovitz, Friedman & Kaplan

[57] ABSTRACT

A fully automated apparatus is provided for processing yarn ends of cops to an automatic winder. The apparatus is adapted for use in combination with a cop feeder which travels along the winder and intermittently and successively charges cops supplied thereto into a number of winder magazines mounted in juxtaposition in the automatic winder. The apparatus is adapted to effect a remaining of the yarn end of the bunch winding of each cop and to draw out the yarn end therefrom. As the yarn end is drawn from the cop the extended yarn is guided toward a suction opening in the magazine and engaged by a cutting member proximate the suction opening to effect a cutting of the yarn causing the yarn to be gripped by the suction opening which then supplies the yarn to said automatic winders.

21 Claims, 23 Drawing Figures

FIG - 17
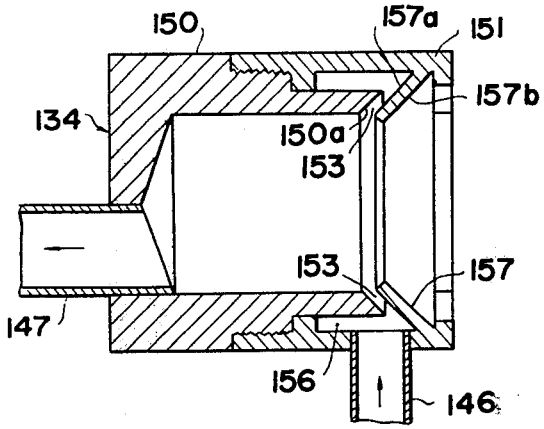
FIG - 19
FIG - 18
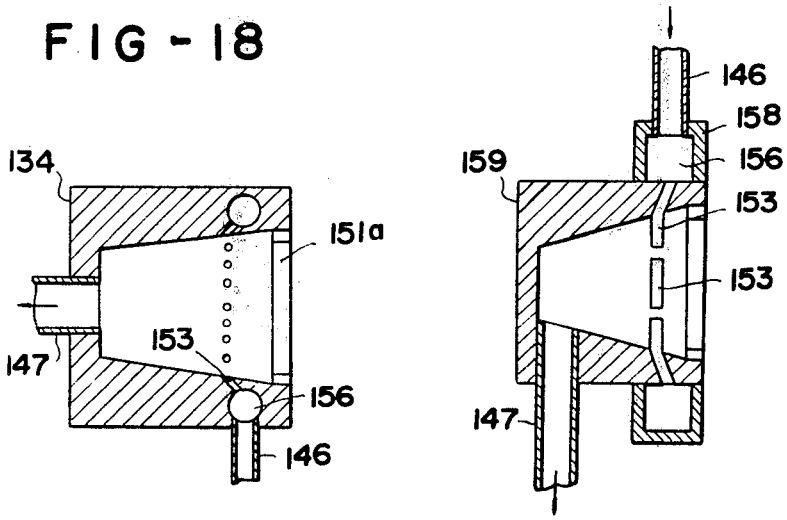

APPARATUS FOR PROCESSING YARN END OF COPS SUPPLIED TO THE WINDER

BACKGROUND OF THE INVENTION

This invention relates generally to an apparatus for processing the yarn ends of cops supplied to an automatic winder, and specifically to an apparatus wherein cops may be fed automatically into the magazine of each winding unit from a cop feeder adapted to travel along the winder, and in which the yarn ends of the cops thus fed may be drawn out and gripped automatically.

Heretofore, when cops were supplied to each magazine of a winding unit of an automatic thread winder, it was necessary for an operator to attend to each winder in order to monitor those magazines which were empty. It was also necessary for the operator to manually draw out the yarn ends one by one and supply the same to the yarn suction opening of the yarn clamp which then gripped the yarn ends by a suction effect. Because such manual operation required considerable time and labor, such winder operations are deemed to be less than completely satisfactory.

Heretofore the use of a mechanical device having a rotating brush or a hook for engaging the bunch winding and drawing out the yarn end, or a suction-type device adapted for drawing out the yarn end through the aid of a suction nozzle have been attempted. However such devices have been unreliable and often cause deteriorated cop quality. Moreover, a number of steps of manual operation were still required for gripping the yarn ends of cops by such suction devices which were mounted in the central part of the magazine. Additionally, often the bunch winding of the cop would cling to the neighboring components of the apparatus. In such devices, the air flow caused by such suction clamps caused a turbulence along the surface of the cop thus causing nap formation on the cop thereby adversely affecting the quality of the cop. Because air flow caused by the vacuum was supplied through a filter provided in the suction nozzle, the effective force of the suction was significantly reduced by the accumulation of the waste yarn in the filter. Thus it was necessary to interrupt the operation of such apparatus to open the filter section and remove the waste yarn each time that the force of the suction was reduced causing expensive down time and increased operating costs.

SUMMARY OF THE INVENTION

Generally speaking, in accordance with the invention, a cop feeder travels along a winder and includes means for stopping the travel of the cop feeder in a position of registry with the magazine of each winding unit and a charging section for automatically charging the cops to a winder magazine. A yarn draw-out unit is adapted for removing the yarn end wound on the cop and drawing out the yarn end after the cop is charged into the magazine. A yarn guide is provided which guides the yarn extended between the yarn draw-out unit and the cop in the magazine to a suction opening provided in the magazine so that the yarn is gripped thereby by the suction force. A yarn cutter is provided for cutting the yarn as it is gripped.

In accordance with another aspect of this invention, the yarn draw-out unit of the apparatus has a tubular main body to which the end of the cop is inserted, an air discharge conduit having filter means connected to one end of said main body, an annular passage formed in the other end of the main body in fluid communication with an air supply conduit connected to a source of compressed air, and a nozzle section adapted for injecting the compressed air from said annular passage to the bunch winding wound on the cop end at a predetermined angle of injection, to effect remaning of said bunch winding by said air injection.

In accordance with still another aspect of this invention, the suction opening is centrally mounted in each magazine of the winder and is adapted to hold the yarn end by suction. A cover is provided for closing the suction opening of the yarn suction means. Yarn guide means are adapted for guiding the yarn end towards said yarn suction means and are further adapted to displace said cover for opening said yarn suction opening.

In accordance with yet another aspect of this invention, a control device is provided for intermittently stopping the cop feeder to effect cop charging into every other magazine when the cop feeder is travelling in a forward direction and to each intermediate magazine when the cop feeder is travelling in a reverse direction. The yarn-end processing apparatus for transferring the yarn end to the magazine yarn clamp and holding the yarn end portion comprises yarn draw-out means for drawing out the yarn end wound on the cop, yarn guide means by which the yarn extended between the yarn draw-out means and the cop when the latter is separated from each other and is drawn towards and gripped by said yarn suction opening, and yarn cutting means by which the yarn thus gripped is cut in a position between the suction opening and the yarn draw-out means.

In accordance with still another aspect of the invention, the yarn guide means includes a first yarn guide means and a second yarn guide means operable in connection with said first yarn guide means, said first yarn guide means being in operation when the yarn guide operation of the second guide means is interrupted by the cop remaining in the charging section of the feeder.

Thus, by providing a tubular main body into which the cop end is inserted, including an annular passage in the other end of the main body which provides fluid communication with the source of compressed air and with the nozzle section for injecting the compressed air to the bunch winding through said annular passage to thereby free the yarn end by removing same. A removing operation is performed even if the winding is in the perturbed condition, and any adverse effects on the yarn quality are eliminated. Since the bunch winding is removed under the force of injection of compressed air without using the suction effect as is the practice in prior art systems, the production of such apparatus is increased because the waste yarn is collected in the filter section thus minimizing down time, as well as reducing the size of such apparatus because the size of the source of compressed air can be minimized. Moreover, since the waste yarn collected in the filter section can be removed without the necessity of stopping the operation of the apparatus, the efficiency of such operation is improved.

Additionally, since the suction means provided in the center of the magazine is normally closed by cover means which may be opened occasionally by the yarn guide means when the latter has guided the yarn to a position above the yarn suction means, the guiding of the yarn towards the suction means and opening or closing of said cover means as well as the resulting gripping of the yarn end may be performed automatically thus contributing to the saving in manpower.

Accordingly, as is hereinafter discussed, the continuous operation of processing the yarn end at the time of feeding of the cops by the travelling cop feeder can be performed with improved efficiency, thus enhancing the productivity and assuring a safe winder operation.

Accordingly, it is an object of this invention to provide a fully automated winder operation to thereby enhance productivity by effecting a continuous winder operation.

Another object of this invention is to provide a simplified, inexpensive and improved apparatus for processing yarn ends of cops, wherein the cops can be supplied automatically into the magazine from a cop feeder travelling along the winder, and wherein the yarn ends of the cops can be precisely gripped under the force of suction by the yarn suction opening of the yarn clamp provided in the central part of the magazine.

Still another object of this invention is to provide an improved apparatus wherein yarn ends of cops are drawn out, guided to a magazine yarn clamp and automatically gripped thereby, thus enabling full automation of the continuous winder operation.

A further object of this invention is to provide an improved apparatus in which the cop feeder may be stopped precisely for charging to every other magazine for reducing the cycle time.

A still further object of this invention is to provide an improved apparatus wherein the yarn end of the cop is drawn of itself towards the yarn suction means of the magazine and the cover of the suction means may be opened automatically for gripping the yarn end by said suction means.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 17 to 19 are side elevational views depicting modified embodiments of the yarn end draw-out apparatus constructed in accordance with the instant invention.

DESCRIPTION OF THE PREFERRED EMBODIMENT

Figure 1:
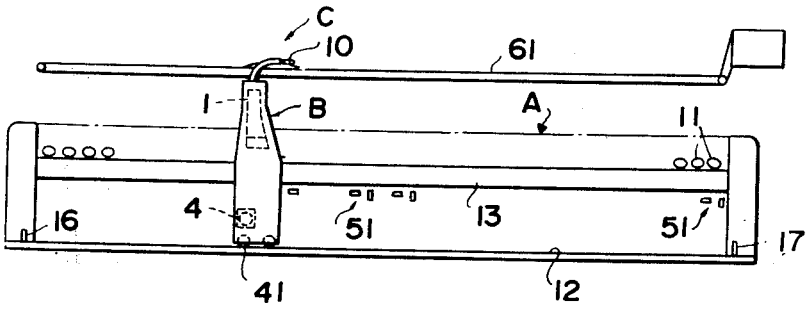
FIG. 1 is a schematic front view of the overall cop feeder and winder apparatus.

Referring now to FIG. 1 there is depicted an automatic winder generally indicated at A provided with a number of yarn winding units and rotary cop magazines 11 for feeding the cops 10 to the winding units. A travelling cop feeder generally indicated at B is mounted on a travelling rail 12 and a guide rail 13 of the winder A for providing reciprocating motion of the feeder along the front face of the winder. The cop feeder B as will hereinafter be discussed has a stop device and a cop charging device for charging the cops 10 in succession into a magazine 11. A cop transfer and delivery unit generally indicated at C for transferring and delivering the cops into the feeder B, is mounted on top of the winder A.

Cop feeder B is adapted for travelling along said winder A and by its positioning with respect to said transfer and delivery unit C automatically supplying the cops 10 carried by said transfer and delivery unit into the magazine 11. Cop feeder B comprises, as depicted in FIGS. 2 to 5, a containing section 1 in the form of a bent conduit to contain a number of cops 10 in rows; a cop feed section generally indicated as 2 formed by a cop feed-out device 2*a* for sequentially and selectively feeding the cops from said section 1 and a guide through 2*b* for guiding the cops during descent through said cop feed section; a charging section generally indicated as 3 adapted to receive and hold the cops at a receiving position below the feed section 2 and for further charging the thus held cops into the magazine 11 when the section is lowered to the charging position proximate to the magazine in a manner to be hereinafter discussed; a driving section generally indicated as 4 adapted for driving a travelling unit 4*a* and a switchover unit 4*b*, including a stop position control section generally indicated as 5 for momentarily stopping the travel of the cop feeder when the same is facing the magazine 11 of the winder A. The travelling unit 4*a* comprises a drive roller 41 and a driven roller 42 adapted to roll on said rail 12 and guide rollers 43 adapted to roll on rail 13, while the switchover unit 4*b* is provided for reversing the direction of reciprocating movement of the cop feeder B.

A cop supply unit, generally indicated as C, for supplying the cops to the containing section 1 of the feeder B includes a conveyor belt 61 mounted on top of the machine frame of the winder A and a chute 62 projectingly mounted from the feeder B and further including an opening disposed on said conveyor belt in opposition to the direction of movement on said conveyor belt. The chute 62 is adapted to pick up and guide the cops laterally and feed them into the containing section 1 which includes a passage therein for receiving a required number of cops in horizontally aligned relation. Upper and lower limit switches SW1 and SW2 are provided in suitable positions along the passage of section 1 for sensing the stored quantity of the cops in section 1. The arrangement is such that the movement of the conveyor belt 61 may be controlled by turning on or off switches SW1 and SW2 in a conventional manner so that the number of cops to be supplied to the section 1 can be adjusted for limiting the quantity of the cops stored therein.

As a modification thereof, the conduit section 1 may be supplied with the cops automatically from a feed hopper mounted in the machine frame when the cop feeder B has travelled to the end of the machine frame.

In the embodiment depicted, each rotary magazine 11 of the winder has six pockets, that is, each magazine has spaces for receiving six cops 10, two cops 10 being supplied simultaneously into each magazine when the latter is absent any cops. However, it is understood that one or three or more cops can be supplied into a corresponding number of pockets.

Feed section 2 is mounted contiguous to the lower end of the conduit section 1 for feeding the cops in succession. The feed section 2 is shown in detail in FIGS. 18 and 19.1 through 19.5 of applicants' U.S. patent application Ser. No. 392,572, filed on Aug. 29, 1973, which application is incorporated by reference herein and comprises a bent operating member 22 pivotally mounted at the bent portion thereof and connected at the other end to a solenoid 21 adapted to prevent the delivery of cops during normal operation but permitting such cops to travel therethrough upon energization of the solenoid 21. A stopper 23 is pivotally mounted at a first end to the operating member 22 for stopping the rolling of the delivered cop 10, the stopper 23 also being rotatable in synchronism with the operating member 22 through a gearing 24 to permit delivery of the cop 10. A support member 26 is mounted below said stopper 23 for carrying one end of the cop 10 and is operatively associated with a solenoid 25 to intermittently permit the descent of the cop 10. A pair of guide plates 27*a* and 27*b* are mounted in juxtaposition below said support member 26 and to the rear of said stopper 23, respectively, for guiding the cop towards the charging section 3 directly over the support member 26 or in the alternative from a position beyond the support member 26. The feed section 2 is adapted in this way to selectively feed two cops into the charging section 3.

Figure 3:
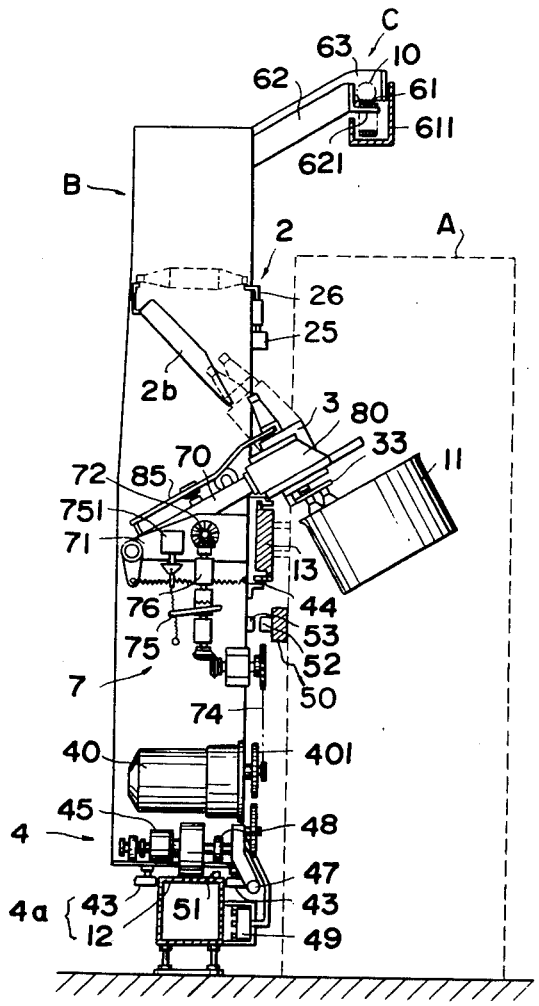
FIG. 3 is a side elevation view of the cop feeder depicted in FIG. 2.
Figure 4:
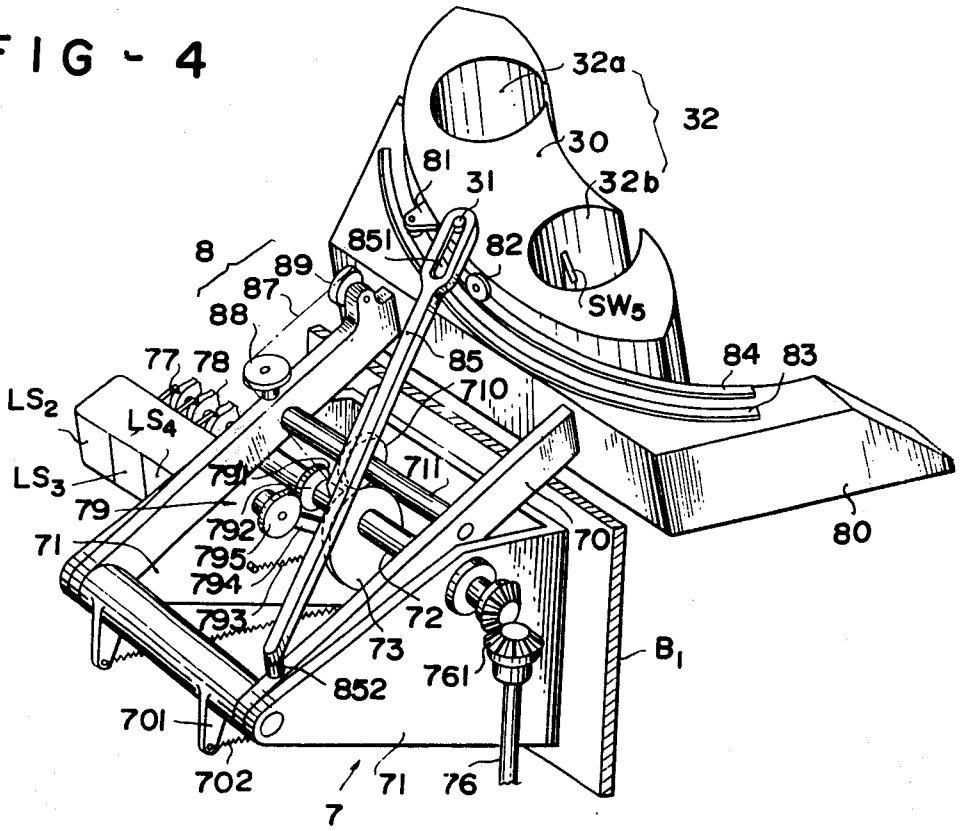
FIG. 4 is a perspective view of the charging section of the cop feeder constructed in accordance with the instant invention.
Figure 5:
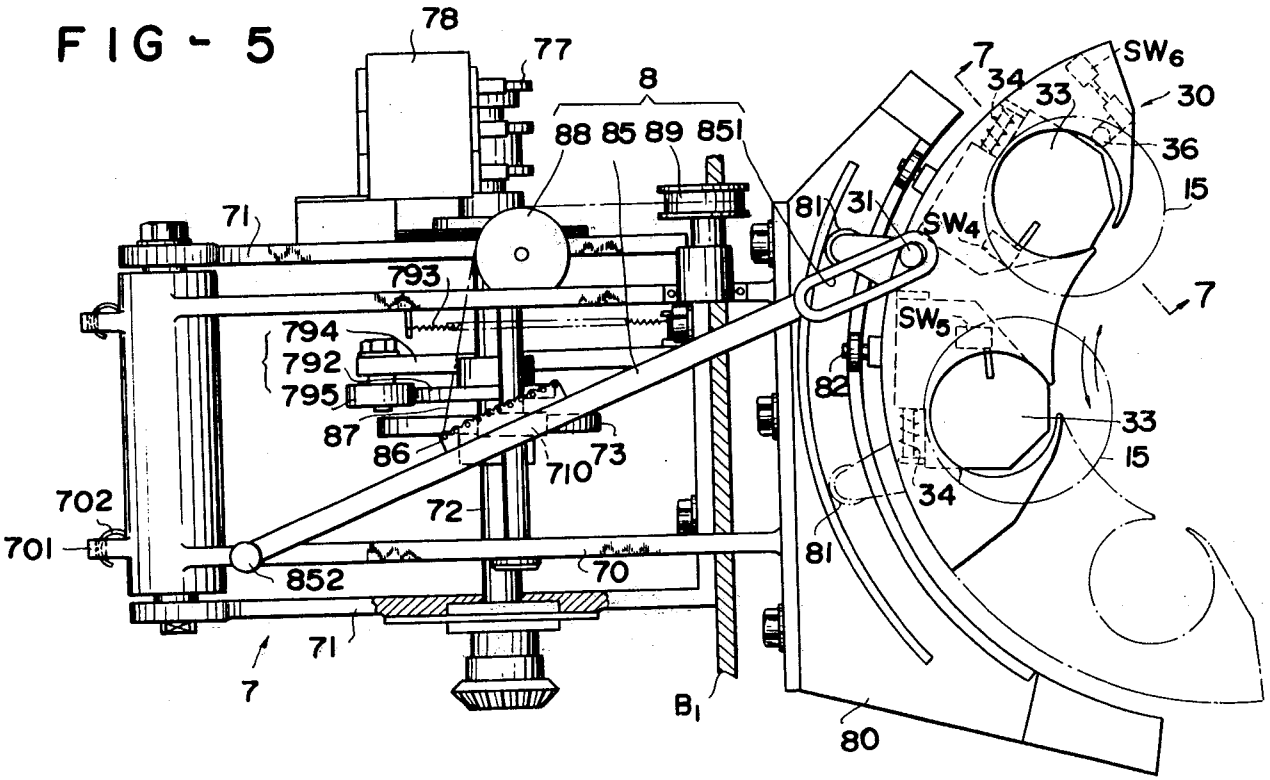
FIG. 5 is a plan view of the charging section depicted in FIG. 4.
Figure 6:
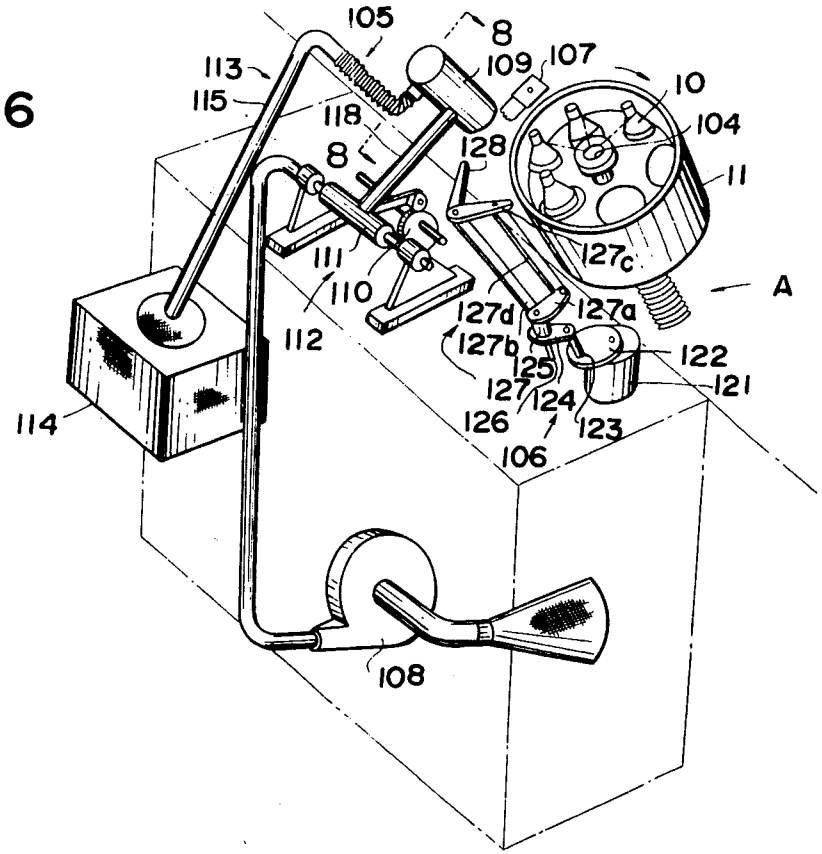
FIG. 6 is a perspective view of the yarn end processing apparatus constructed in accordance with the instant invention.
Figure 7:
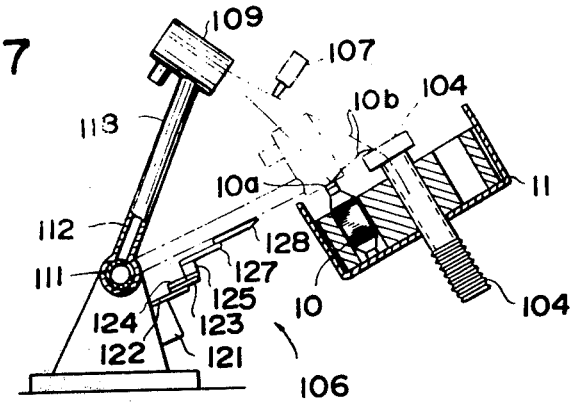
FIG. 7 is a side elevational view, partly in section, of the yarn end processing apparatus depicted in FIG. 6.

As is illustrated in FIGS. 3 to 5, the charging section 3 comprises a charging member 30 for receiving and holding the cop 10 delivered from the feed section 2. Lift means, generally indicated as 7, is provided for moving the charging member 30 upwards to the cop receiving position or downwards to the cop charging position. An entrainment means is mounted proximate to the magazine 11 and is adapted for movement with the rotation of the magazine to synchronize the cop charging operation with the rotation of the magazine 11. A self-adjustment device generally indicated as 8, and cop charging control means generally indicated as 9 are adapted for sensing the presence or absence of the cop 10 in the magazine pocket and selectively charging the cop held by the charging member 30.

The lift means 7 is so constructed that the charging member 30 is slidably carried by the end of lift frome 70 which is pivotally mounted to a pair of support brackets 71, which are further secured to a stationary portion of the main body of the feeder B in a well known manner. A cam follower 710 is mounted to a transverse rod 711 of lift frame 70 which follower rests on a cam 73 mounted on control shaft 72, which shaft is rotatably carried at both ends by support brackets 71. Thus, as is appreciated, the lift frame 70 can be moved upwards to the cop receiving position or downwards to the cop charging position by the rotation of the control shaft 72.

A gear mounted on the end of the control shaft 72 is in meshing engagement with an end gear 761 of rotary shaft 76 which is connected to driving unit 40 of the driving section 4 through a magnetic clutch 75 and motion-transmitting means 74. Rotation of control shaft 72 is controlled by operation of the magnetic clutch 75, the operation being effected by switches $LS_2$ and $LS_3$ mounted opposite a cluster of gears 77 and 78 which are disposed on the end of control shaft 72 and by sensor switch $SW_3$ of the stop position setting section 5 which is hereinafter decribed.

When the lift frame 70 is elevated and thus moved away from the magazine, gears 77 and 78 disposed on the end of control shaft 72 effect an opening of the microswitch $LS_2$ by the movement away from said microswitch and further effects a disengagement of magnetic clutch 75 of the lift means 7 to thereby interrupt the driving of the control shaft 72 and the lift frame 70. Switch $LS_3$ is closed when the rotation of the control shaft 72 comes to a halt, so that the driving of the travelling unit 4*a* is begun.

Additionally, there is provided a device generally indicated as 79, adapted to stop the rotation of the control shaft 72 which comprises a stop cam 792 having a peripheral recess 791 and being adapted to rotate with the control shaft 72. Arm 794 is pivotally mounted at the base end thereof to support bracket 71 the device is further provided with a roller 795 that is caused to abut lightly on said stop cam 792 by a spring 793. This stopping device is adapted for engaging and holding the control shaft 72 when the lift frame 70 is raised toward the cop receiving position and prevents the whittling of the shaft 72 and the frame 70 during movement of the cop feeder B.

The rotational moment caused by the weight of the lift frame 70 and the charging member 30 is counterbalanced by a spring 702 mounted between boss 701 formed on the base end of the lift frame 70 and the bracket 71.

A self-adjustment unit, generally indicated as 8, is provided for rotatably carrying charging member 30 and comprises a swingable guide frame 80 mounted to the foremost part of the lift frame 70 and having an arcuate side disposed concentric with the periphery of the magazine 11. Rollers 81 and 82 are mounted on the rear face of charging member 30 and are adapted to engage guide rails 83 and 84 which are respectively mounted on guide frame 80 for movably carrying charging member 30 along an arcuate path in cooperation with the magazine 11.

The base end of lever 85 is pivotally mounted at 852 to the lift frame 70. The other end of lever 85 includes elongated opening 851 in which is disposed a boss 31 formed on charging member 30. Lever 85 has a row of openings 86 to which is fastened one end of a cable 87 which cable is further wound around rollers 88 and 89 and secured at the other end thereof to a weight (not shown) so that lever 85 is partially rotated by the rotative force utilized for positioning the charging member 30 in the cop receiving position.

The charging member 30 is formed with a segmented shape corresponding to the contour of magazine 11, as is depicted in FIG. 5, and has a pair of longitudinal cop-receiving cavities 32*a* and 32*b* in registry with the positions of the guide plates 27*a* and 27*b* of feed section 2, and further are provided to conform to the distance between adjacent cops to be received in the magazine 11. Cover plates 33 are pivotally mounted to the lower end of the respective cavities 32. A return spring 34 having a small spring force is mounted to each cover plate 33 for urging the cover plate to close the cavity 32 but permit the cover plate to pivot to thereby open the cavity 32 formed thereby due to the weight of the cop on the cover plate so that the cop can be selectively delivered into the magazine The yarn end catching device is illustrated in FIGS. 6 to 9 and is constructed so that the end of the yarn supplied to the magazine 11 of the winder A is drawn out and sucked into a vacuum opening 104 of a yarn clamp, which vacuum opening is mounted proximate to the center of the magazine so that the end of the yarn is held there until the time that the cop is exchanged to obtain an efficient yarn joining operation. The yarn end catching device comprises a yarn draw-out unit generally indicated as 105 into which the cop 10 is partially insertable and by means of which the bunch winding 10*a* of cop 10 is removed in order to draw out yarn end 10*b*. A yarn guide unit, generally indicated as 106, for guiding the yarn end 10*b* which extends between the draw-out unit 105 and the cop 10 towards the vacuum opening 104 in the magazine 11 is provided. When the unit 105 is raised and thus spaced from the cop 10, such drawing out is achieved by catching the yarn end under suction. A yarn cutting unit 107 is provided for cutting the yarn which is caught in a position between such cutting unit and the yarn draw-out unit 105. This yarn-end processing device may be provided on the winder A for each magazine 11 or in the alternative may be provided on a truck movable along the winder A and adapted for intermittently stopping in front of each magazine for yarn end processing, to thereby reduce the cost of such equipment.

The yarn draw-out unit 105 is adapted for removing the bunch winding 10*a* of the cop 10 with the aid of a jet of compressed air. The draw-out unit 105 is comprised of an air supply unit, generally indicated as 112, a main body 109 and an air discharge unit, generally indicated as 113, connected to the end of the main body 109. The air supply unit 112 is coupled to compressed air source 108 and is further pivotally coupled at one end to cylindrical bottomed main body 109 to thereby comprise a pivot device 110 for imparting a vertical movement to the main body 109 as well as to provide a valve 111 which opens to the air jet during the downward stroke of the draw-out unit when the cop is inserted but interrupts the air jet otherwise.

Figure 8:
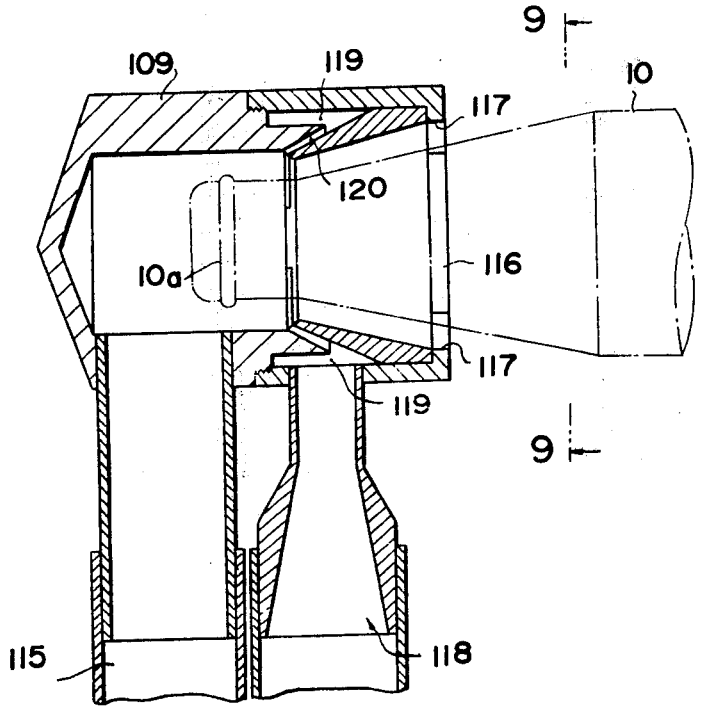
FIG. 8 is an enlarged sectional view taken along line 8—8 of FIG. 6.
Figure 9:
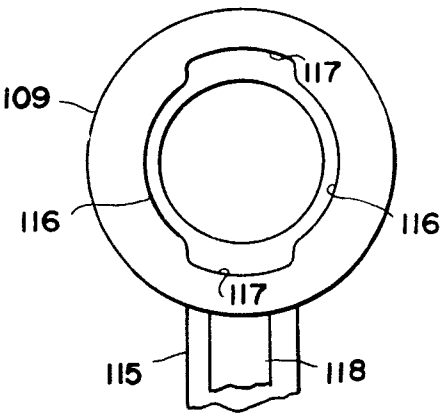
FIG. 9 is a sectional view taken along line 9—9 of FIG. 8.

Main body 109 has the shape of a bottomed cylinder into which the end of the cop 10 may be inserted as is shown in FIGS. 8 and 9 to effect removing of the bunch winding 10*a* wound on the foremost part of the cop 10 and drawing out of the yarn end 10*b*. An air discharge conduit 115 of the air discharge unit 113 includes a filter 114 at a first end and is connected at the other end to the main body 109 proximate to the closed bottomed end thereof. The open end of main body 109 forms a rim defining a projecting portion 116 which projecting portion positions the cop 10 in the inserted position, and a recessed portion 117 to permit the intake of secondary air. The inner surface proximate the open end of main body 109 is tapered to conform to the conical surface of the cop and has an annular passage 119 which provides an air communication with air supply conduit 118 of the air supply unit 112. An air injection nozzle 120 in the form of a hole or slit is formed at a certain angle and provides air in communication with said annular passage for supplying the air jet to the bunch winding 10*a* at a given pressure to thus remove the winding and hence draw out the yarn end 10*b* as the air is discharged through the air discharge unit 113.

Figure 10:
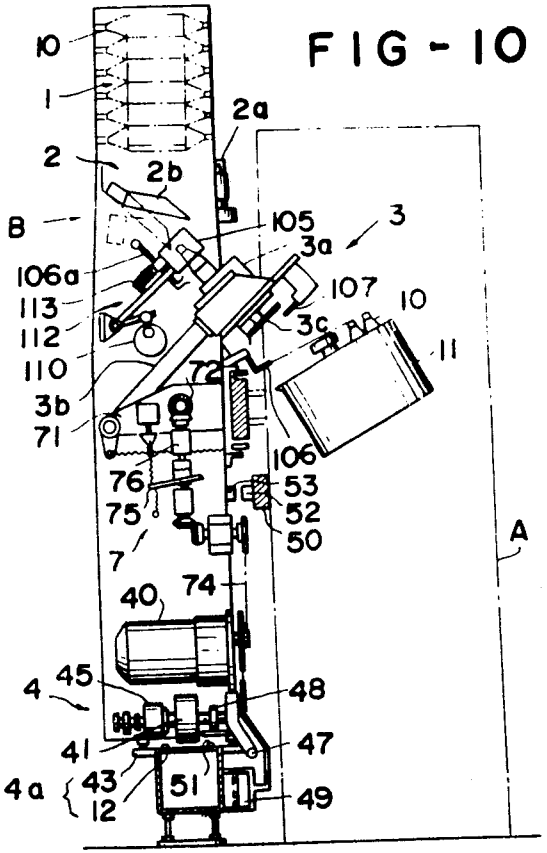
FIG. 10 is a side elevational view showing an alternative embodiment of the yarn end processing apparatus operatively associated with the charging section of the cop feeder.
Figure 11:
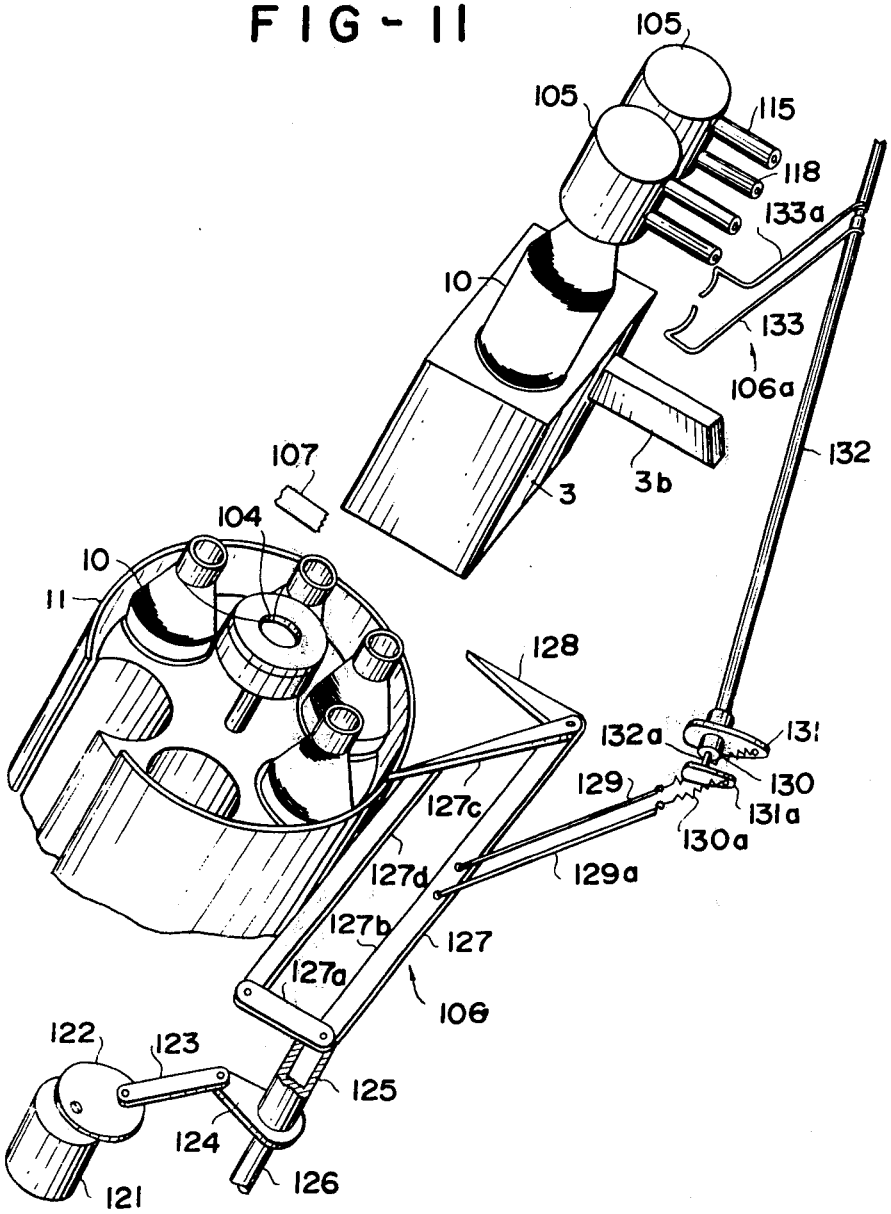
FIG. 11 is a perspective view of the alternative yarn end processing apparatus depicted in FIG. 10.

A yarn guide unit generally indicated as 106 is in the form of scissors which are movable in a horizontal direction towards the vacuum opening 104 to a position above the magazine 11, as depicted in FIGS. 10 and 11. A crank 122 rotatably driven by an electrical motor 121 is connected via a lever 123 to a lever 124 which lever is secured to a hollow rotational shaft 125 which includes a fixed concentrical shaft 126. A first arm 127*a* of a four-arm link 127 is secured to said fixed shaft 126, said link 127 also comprised of second, third and fourth arms 127*b*, 127*c* and 127*d*. The second arm 127*b* is secured at one end to said hollow shaft 125 and at the other end thereof is provided with a first yarn guide 128 which guide projects outwardly from the fourth-arm link, said yarn guide 128 forming a scissors-like unit together with the said third arm 127*c* for guiding the yarn. the yarn guide 128 and the third arm 127*c* are provided with yarn guide inner surfaces and are capable of guiding a plurality of yarns at the same time.

The yarn cutting unit 107 is in the form of a hair clip and is located so that the cutting edge is positioned on a straight line connecting the center of the main body 109 of the yarn draw-out unit 105 and the yarn vacuum opening 104 of the magazine 11. The yarn cutting unit 107 is adapted to cut the yarn at the same time that the yarn end is caught and guided to the vacuum opening 104 by said yarn guide unit 106. The cutting unit 107 may be operatively associated with the yarn guide means or in the alternative permanently driven.

In the instant yarn-end process, when a cop 10 is charged from the cop feeder B into a magazine 11, the yarn draw-out unit 105 is lowered and the end of the cop 10 is inserted by such lowering into the main body 109 thereof. The cop is positioned within the main body 109 with the projecting portion 116 of said main body abutting the conical surface of the yarn wound on the cop 10. The compressed air is then supplied through conduit 118 and through annular passage 119 and is discharged onto the bunch winding 10*a* at an appropriate angle through nozzle 120. The bunch winding 10*a* of cop 10 is removed by the air current. The air jet causes a secondary air current to flow through the recessed rim portion 117 of the main body 109 to assist in the removing of the bunch winding. The removed yarn is delivered to the filter 114 through conduit 115 and separated from the air to be stored therein. After the end of the yarn is thus drawn out, the drawout unit 105 continues by use of suction to hold the end of the yarn and is raised to its starting position to thereby extend the yarn between the unit 105 and the cop.

The yarn guide unit 106 then becomes operative. Electrical motor 121 is driven to thereby rotate hollow shaft 125 in a clockwise manner by means of crank 122, lever 123 and lever 124.

Accordingly, second link arm 127*b* is rotated clockwise, hence drawing toward each other third link 127*c* and yarn guide 128 and causing third link 127*c* and yarn guide 128 to be drawn towards each other and both moved toward the vacuum opening, while the extended yarn is positioned between the guide surfaces. When the base end of the yarn guide 128 is positioned directly above the vacuum opening 104 of magazine 11, the yarn end is attracted by the vacuum into the vacuum opening 104. The yarn extending between the vacuum opening and the draw-out unit 105 is cut by cutting unit 107, and the cut yarn is drawn into the vacuum opening 104 or is caught by the draw-out unit 105. The rotation of lever 124 is then reversed and the yarn guide 128 is returned along with the yarn guide unit 106 to the initial position.

In the embodiment depicted in FIGS. 10 and 11, the yarn-end processing unit is in combination with cop feed B and is provided to travel alongside the winder A and to charge the cop 10 into each magazine 11. A yarn draw-out unit 105 which is similar to the one disclosed in the preceding embodiment is provided and is vertically movable in order to remove the bunch winding 10*a* of the cop 10 when it is received by the charging unit 3. A second yarn guide unit 106*a* is also provided in combination with said draw-out unit 105 between the feed section 2 and the charging section 3. In addition, there is provided a yarn guide unit 106 which is the same as the unit depicted in the preceding embodiment and so designed that the yarn extending between the cop in the magazine 11 and the yarn draw-out unit 105 is guided to the vacuum opening 104 during the moment that the charging section 3 is raised to the cop receiving position after the cop 10 is charged into the magazine 11. Also, a yarn cutting device 107 is mounted to the lower foremost part of the charging unit 3.

The second yarn guide unit 106*a* is operatively associated with the first yarn guide unit 106 and includes connecting rods 129 and 129*a* which rods are each engaged at one end thereof with second link arm 127*b* and at the other end of said rods with coil springs 130 and 130*a*. Arms 131 and 131*a* carry said coil springs and are each secured to rotatable shafts 132 and 132*a*, shaft 132 being a hollow shaft in which the other shaft 132*a* is concentrically inserted. Finally, second yarn guides 133 and 133*a* are respectively secured to shafts 132 and 132*a* and extend in a space between said yarn draw-out unit 105 and the charging section 3.

Figure 12B:
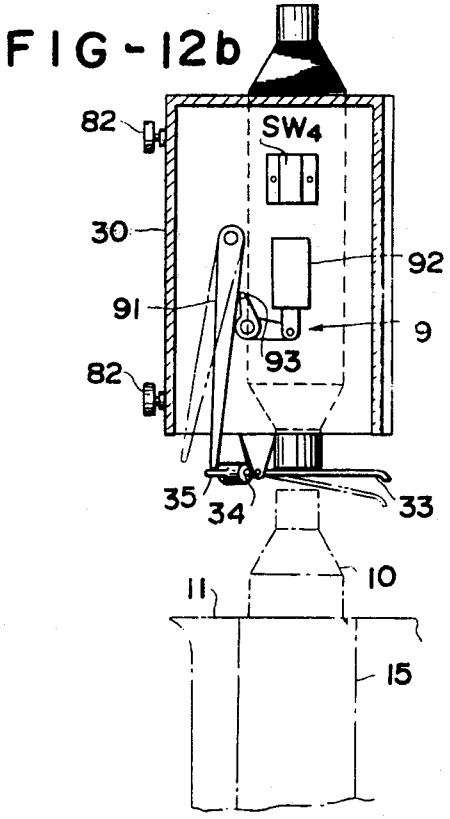
FIG. 12*a* and 12*b* are section side elevational views of the cop-charging section depicted in different operative states.
Figure 12A:
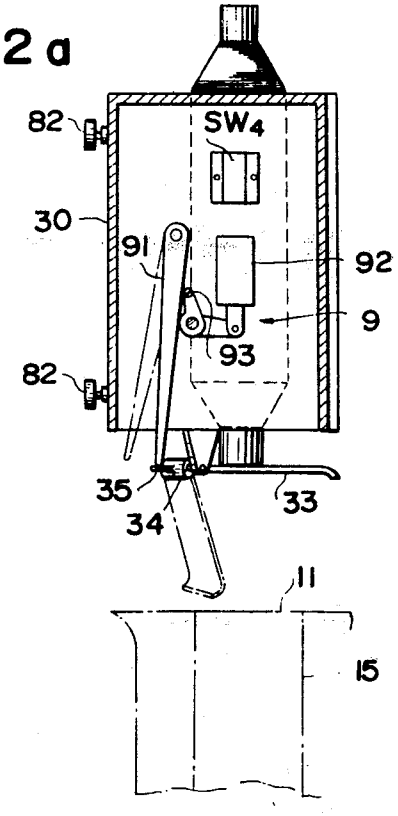

The end part of the cover plate 33 of the charging section 3 has a boss 35 as is illustrated in FIGS. 12*a* and 12*b*. There is provided a charging control means, generally indicated as 9, comprising a detent lever 91 pivotally mounted at a first end and engaged with said boss 35 at its other end on the cover plate 33 to hold the cover plate 33 in the closed position. A release lever 93 is mounted in proximity to said detent lever 91 and is partially rotatable when a solenoid 92 is energized in order to forceably disengage said detent lever 91 from the boss 35 on the cover plate 33. In operation, when the charging member 30 is lowered, the cover plate 33 is opened under the weight of the cop by disengaging said detent lever 91, so that the cop is dropped by its own weight. If the cop remains in the cop pocket 15, the cover plate 33 is hindered from opening due to the contact thereof with the remaining cop, and is again locked in the closed position immediately before lifting of the charging member 30 due to the reengagement of detent lever 91. The cop charging operation can thus be regulated by the presence or absence of the cop in the magazine 11. In the cop-receiving cavities 32*a* and 32*b* there are mounted switches $SW_4$ and $SW_5$ having sensitivity means projecting into the holes for selective actuation of the feed section 2 based on the presence or absence of the cops in the cavities.

In the yarn end processing device shown in FIGS. 10 and 11 the cover plate 33 is obstructed from opening due to the engagement of the detent lever 91 with boss 35, when cop 10 descends from the feed section 2 onto the charging member 30 of the charging section 3. The yarn draw-out unit 105 is then lowered and the cop end is inserted into its main body 109. Thereafter, the bunch winding 10*a* of the cop is removed in the manner herein described and the unit 105 is returned to its starting position while holding the yarn end. Then, the charging member 30 is lowered to a position proximate to magazine 11. As the signal is produced for termination of the downward movement of the charging member 30, the solenoid 92 is energized, and the detent lever 91 is disengaged from the boss 35 by operation of the release lever 93. Cover plates 33 are then opened by the weight of cops 10 to thereby effect simultaneous delivery of one or two cops into the magazine 11. After charging the cops into the magazine, the charging member 30 is raised to its original position. At this point, the yarn extends from the yarn draw-out unit 105 and the cop 10 held by the magazine 11.

Next, the first yarn-guide unit 106 becomes operative in the same manner as in the preceding embodiment described above and the connecting rods 129 and 129*a* of the second yarn guide unit 106*a* are simultaneously pulled therewith so that shafts 132 and 132*a* are partially rotated by arms 131 and 131*a*. The end part of the extending yarn is pushed by the second yarn guides 133 and 133*a* and the yarn end is thus guided towards the vacuum opening 104 of the magazine and caught there by the suction created thereby. Simultaneously therewith, the yarn is guided to the cutting device 107 by the second yarn guide unit 106*a* and cut by the cutting device 107. The remaining yarn is introduced into the vacuum opening 104 and the waste yarn is discharged towards the discharge filter 114 of the yarn draw-out unit 105.

When the magazine operation is caused to unintentially stop and the charging member 30 is lowered to the magazine 11 while a cop 10 is held in the magazine, the cover plate 33 is prevented from opening due to the obstruction caused by the direct contact with the top of the remaining cop, even though detent lever 91 is disengaged, as indicated by the dotted line, as a result of the transmitted signal. The detent lever 91 re-engages the boss 35 as the charging member 30 is again elevated and returned to its starting position together with cop 10 which remains therein. Double delivery of the cops may be prevented by controlling the delivery operation of the feed section 2 by providing sensor switches $SW_4$ or $SW_5$ in the charging member 30. During operation of the first yarn guide unit 106, the second yarn guide unit 106*a* tends to enter into a yarn guiding operation, but the second yarn guide 133 or 133*a* abuts on the cop 10 remaining in the charging member 30. Since rotation of shaft 132 or 132*a* is obstructed, and the rotational force of the shaft is absorbed by the stretched coil springs 130 and 130*a*, the operation of the second yarn guide unit comes to a halt without being hindered.

The yarn-end draw-out unit shown in FIGS. 13 to 16 comprises a cylindrical main body 134 in which the cop end is inserted, an air discharge section generally indicated as 135, which is coupled to the other end of the main body 134, and an air supply section, generally indicated as 136, which is coupled to main body 134 near its open end and is adapted to inject air under pressure and at a certain angle to the bunch winding 10*a* wound on the cop end and effect removal of the bunch winding 10*a*. A pivot device 137 is fitted to the air supply section 136 for raising and lowering said main body 134.

Figure 13:
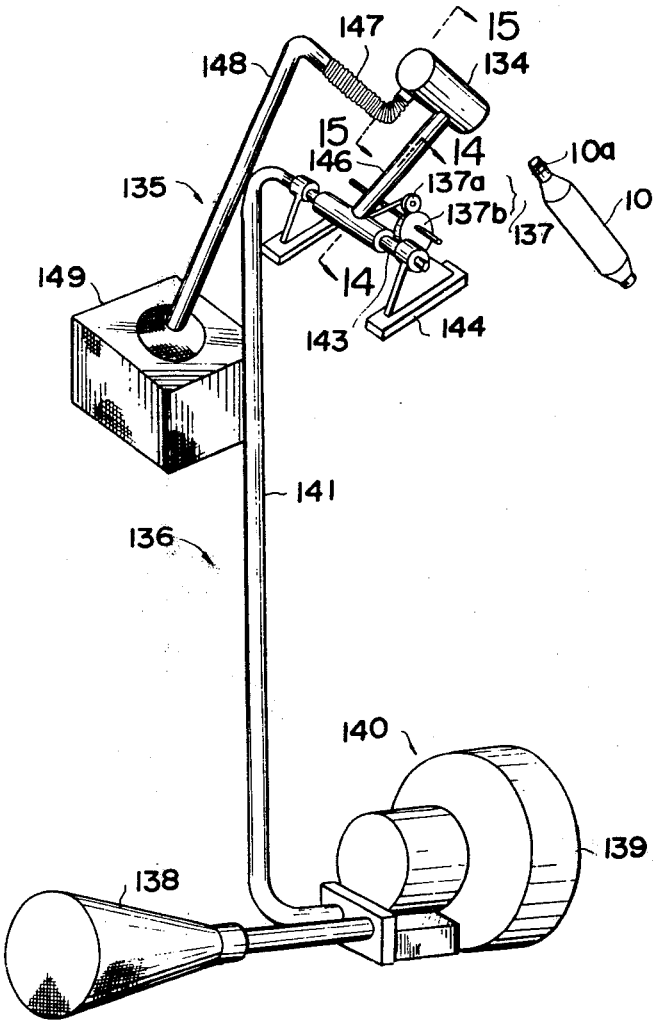
FIG. 13 is a perspective view of an alternative embodiment of the yarn end drawing out apparatus constructed in accordance with the instant invention.
Figure 14:
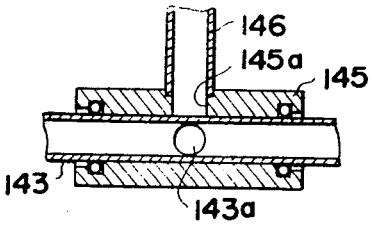
FIG. 14 is a sectional view taken along line 14—14 of FIG. 13.
Figure 16:
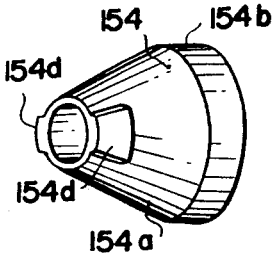
FIG. 16 is a perspective view of a yarn guide piece insertable in said drawing out apparatus depicted in FIG. 14.
Figure 15:
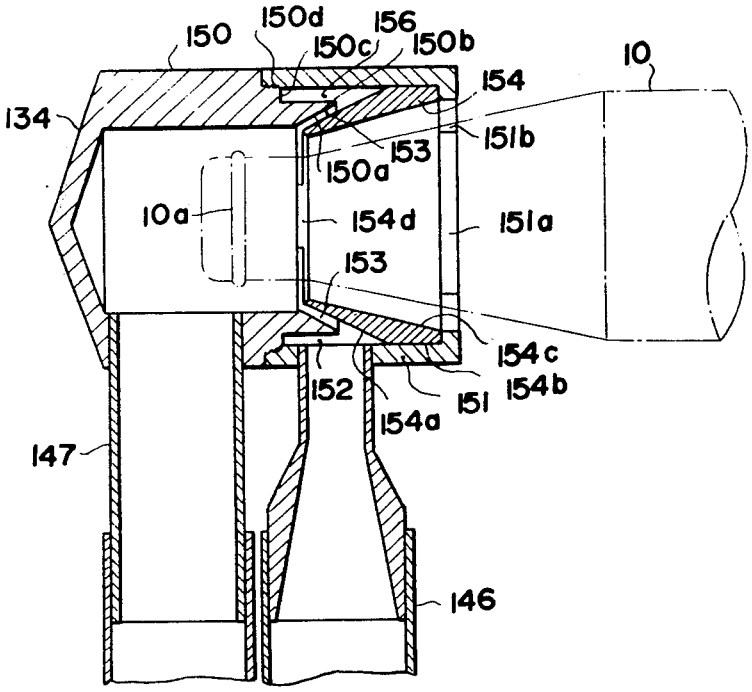
FIG. 15 is a sectional view taken along line 15—15 of FIG. 13.

Referring to FIGS. 13 and 14, the air supply section 136 has a source of compressed air 140 such as a compressor which includes filter 138 and a suction blower 139, said air source 140 being connected through a pipe 141 to a hollow support shaft 143. Hollow support shaft 143 is carried by a pair of brackets 144 and includes an air vent 143*a* formed therein. To this support shaft 143 is rotatably fitted a hollow shaft 145 having an air vent 145*a* formed therein and in alignment with said air vents 143*a*. An air pipe 146 is coupled to and in air communication with air vent 145*a*, and a projecting arm carrying an end roller 137*a*. This end roller 137*a* and cam 137*b* engaged therewith constitute the abovementioned pivot device 137 which is adapted to raise and lower the air pipe 146 in a vertical plane. The arrangement is such that, as the end of the cop 10 is inserted into the cylindrical main body 134 which is coupled to the end part of the air pipe 146, the compressed air is injected through vents 143*a* and 145*a* which are now in fluid communication with each other.

The air discharge section 135 comprises a flexible pipe 147 which opens into the bottomed portion of the main body 134, a discharge conduit 148 and a filter 149 adapted to provide storage of the waste yarn.

The tubular main body 134 includes a bottomed cylindrical base portion 150, a cylindrical cap 151 fitted onto the open end of the base portion 150, and a guide piece 154 mounted between the base portion 150 and the cap 151 for defining an annular air passage 152 and a nozzle 153. The air discharge section 135 opens into the wall of the base portion 150 near its bottomed end, and the other end of the base portion 150 is formed by a conical surface 150*a* contiguous to a cylindrical portion 150*b* of reduced diameter, a shoulder 150*c* and an engaging portion 150*d*. The cylindrical cap 151 can be threaded or fitted to said engaging portion 150*d* at the open end thereof, and has a plurality of spaced flanged portions 151*a* at the other end for engagement with the conical winding on the cop and to define air passages 151*b* for communicating with the ambient air. The radial extent of the positioned flanged portions 151*a* is such that the cop 10 can be introduced into the main body 134 so that the air is impinged on the bunch winding 10*a* at a predetermined angle of injection. Guide piece 154 is disposed between base portion 150 and cap 151 and has a cylindrical portion 154*b* for providing insertion thereof into said cap 151, and an inner conical surface 154*a* substantially conforming to the conical surface 150*a* of the base portion 150, and an outer conical surface 154*c* substantially conforming to the conical winding of the cop 10. The rim of the guide piece 154 is formed with several circumferentially spaced apart projections 154*d* that abut the conical surface 150*a* of the base portion 150 to define a nozzle section 153 between the conical surface 150*a* and the conical surface 154*a*. Projections 154*d* can be inclined or twisted in order to generate a vortex of the air current in the removal direction of the bunch winding 10*a*. Thus, an annular air passage 156 is defined by the cylindrical portion 150*b* of the base portion 150, the inner surface of the cap 151 and the outer conical surface 154*a* of the guide piece 154 to provide a passage to air supply section 136.

In the embodiment depicted in FIG. 17, the cap 151 and the guide piece 154 of the embodiment of FIGS. 13 to 16 are made as one piece. The inner wall of the open end of cap 151 is formed with a conical flange 157 to direct the air to the discharge side. The cap 151 is further provided with an outer conical surface 157*a* and an inner conical surface 157*b*. A nozzle section 153' is defined by the outer conical surface 157*a* and the conical surface 150*a* of the base portion. In this case, it is not alwasy necessary to provide the projections 154*d* as in the preceding embodiment.

In the embodiment shown in FIG. 18, the cylindrical main body 134 is formed as one piece and both the cap and the guide piece are dispensed with. The flanged portion 151*a* for positioning the cop is provided as in the preceding embodiment and the main body is formed integrally by casting it with an annular passage 156 near its one end and an annular nozzle section 153 contiguous to the annular passage 156.

Still another embodiment of a tubular main body is depicted in FIG. 19, wherein like reference numerals are used to denote like elements. An annular channel 158 to provide an air passage with the air supply section 136 is provided around the open rim of the base portion 159 as an annular passage 156 in which a continuous or an interrupted nozzle section 153 is provided for communicating with the inside space of the main body 134.

In the above constructions, reference again being made to FIGS. 13 to 16, the compressed air is supplied by the air source 140 of the air supply section 136 into the hollow space of the support shaft 143 through pipe 141. When the main body 134 is spaced upwards from the cop 10, the air vent 145*a* on the hollow shaft 145 is not aligned with and therefore is not in communication with the vent 143*a* on the support shaft 143. When the cam 137*b* is partially rotated by operation of the pivot device 137, the air pipe 146 is rotated around the shaft 145, and the conical winding of the cop 10 is introduced into the main body 134, until the flange 151*a* of the cap 151 abuts the conical winding of the cop 10. At this time, the vent, 145*a* in hollow shaft 145 is in alignment with the air pipe 146, and compressed air is injected at a desired angle to the bunch winding 10*a* through the nozzle. section 153 and the annular passage 156 to effect removal of the bunch winding 10*a*. The jet of compressed air causes the secondary air to flow through the air passage 151*b* of the cap 151 to help removed the bunch winding 10*a*. The removed yarn is delivered to the filter 149 through the discharge conduit 147. Preferably, the discharge conduit 147 is mounted at right angles to the main body 134 and the axis of the cop 10, so that the cop end is not spaced from the discharge section 135, since the yarn removal is limited in this case to the bunch winding in order to prevent unnecessary removal.

Figure 20:
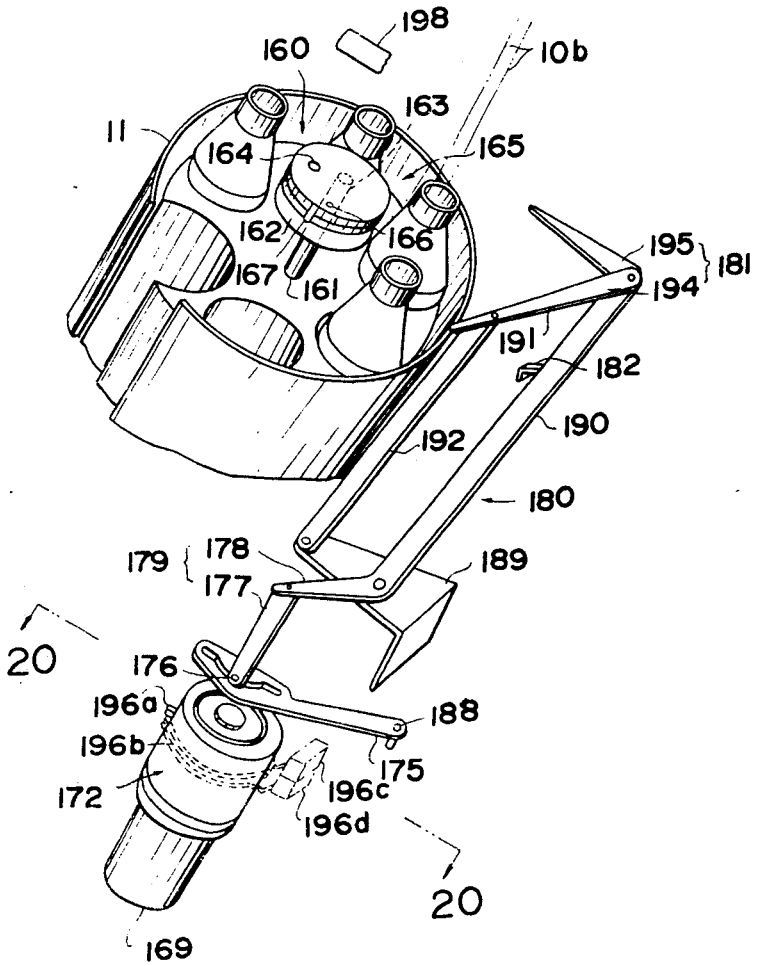
FIG. 20 is a perspective view showing alternate embodiment of the yarn end gripping device constructed in accordance with the instant invention.
Figure 21:
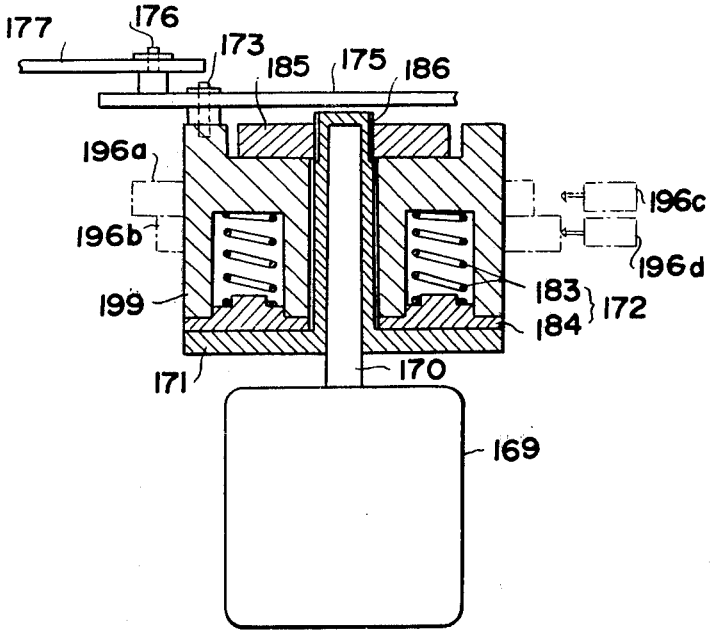
FIG. 21 is a sectional view taken along line 21—21 of FIG. 20.
Figure 22:
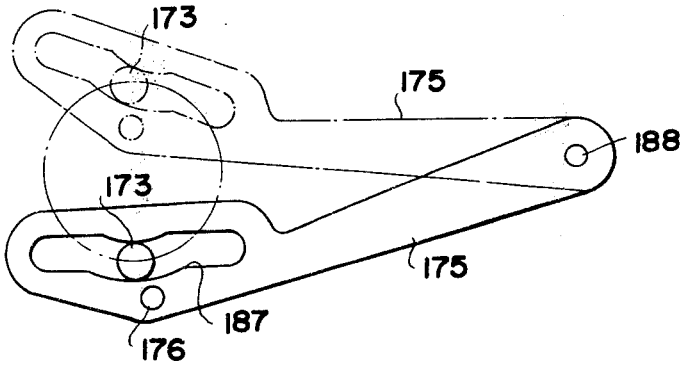
FIG. 22 is a plan view of the lever depicted in FIG. 20.

A modified embodiment of the yarn end catching device of the instant invention is depicted in FIGS. 20 to 22. A yarn suction mechanism, generally indicated as 160, is centrally mounted proximate the rotary magazine 11 and comprises a suction pipe 161 coupled in air communication with a suction source (not shown). A base plate 162 is provided through which said suction pipe 161 is extended to form a suction opening 163. A main cover 165 is provided and includes a suction hole 164 formed therein for introduction of the yarn end 10*b* of the cop 10 therein and mounted by a pin 166 on the base plate 162, to perform an eccentrical rotation relative to the base plate 162. A stop (not shown) is provided and is mounted between the main cover 165 and the base plate 162, for regulating the rotational position of the main cover 165. The main cover 165 has a thrust piece 167 on its lateral surface, and a helical spring (not shown) which is disposed between the lower surface of the main cover 165 and the pin 166, for closing the suction opening 163, during normal operation.

The yarn guide mechanism by which the yarn end 10*b* of the cop 10, which extends between the yarn draw-out unit and the cop 10 charged into the magazine 11 through a charging device (not shown), is guided toward said yarn suction mechanism 160 includes a collar 171 fixed to the shaft 170 of electric motor 169. A tubular body 199 is fitted concentrically over the motor shaft 170 and is caused to be rotated by said shaft through a frictional clutch 172. A lever 175 is pivotally mounted at one end thereof to tubular body 199 by having a crank pin 173, which is formed on said body 199, disposed in sliding engagement in slot 187 of lever 175. The lever 175 is further connected to a four-arm link, generally indicated as 180, the lever 175 effecting an operation of said four-arm link 180 by means of a connecting mechanism 179 which includes a connecting rod 177 pivotally mounted to said lever 175, a connecting lever 178, a yarn guide 181 which forms a scissors-like unit with one arm of the link 180, and an operating piece 182 projectingly mounted to said link 180.

As depicted in FIG. 21, the frictional clutch 172 includes a compression spring 183 mounted in a recess defined by tubular body 199. Friction plate 184 urges the spring 183 into frictional contact with the upper surface of the collar 171. A keep nut 185 is threadably mounted to the cylindrical portion 186 of the collar 171 and prevents accidental removal of the tubular body 199. As shown in FIG. 22, the lever 175 has an elongated slot 187 for insertion of the crank pin 173 and is adapted to be pivotally mounted at the opposite end 188. The slot 187 has two straight end sections and an arcuate intermediate section which intermediate section is defined by a radius of curvature equal to the radius of rotation of the crank pin 173. The included angle of the arc is selected to obtain the desired halt time. Thus, the crank pin 173 is adapted to slide in the slot 187 in order to impart the desired swinging movement. As depicted in FIG. 20, link 180 comprises a first arm 189 which is fixed to the feeder (not shown), a second arm 190, a third arm 191 and a fourth arm 192, with one end of the second arm 190 being integrally formed with connecting lever 178 and pivotally mounted to the fixed first arm 189. First yarn guide 195 is extended from the other end of the second arm 190 to form a scissors-like yarn guide unit 181 with the second yarn guide 194 which is formed by the third link arm 191. As the yarn guide unit 181 is moved toward the yarn suction unit 160, the legs of the scissors are drawn towards each other to effect guidance of the yarn. As link 180 is pivoted by the rotation of tubular body 199, the yarn end 10*b* is guided and transferred by the guide unit 181 to the yarn suction mechanism 160. At the same time, the operating piece 812 formed on the lower surface of the second link arm 190 engages the thrust piece 167 to open cover 165 of the yarn suction mechanism 160.

Cams 196*a* and 196*b* are adjustably positioned on the outer surface of the tubular body and are adapted to engage switches 196*c* and 196*d* to thereby produce instruction signals. First cam 196*a* and switch 196*c* cooperatively act to produce an instruction signal for cutting the yarn and second cam 196*b* and switch 196*d* cooperatively act to produce an instruction signal for stopping the operation of the motor 197.

When the bunch winding wound on the end of the cop 10 which is disposed in the magazine 11 is removed by the yarn drawout mechanism (not shown), then supplied to the cop feeder, and the yarn end 10*b* is drawn out, the cop 10 is charged into a pocket of the magazine 11.

The motor 169 is started by actuation of the switch which is caused by the resetting of the charging section. Tubular body 199 is rotated clockwise causing lever 175 to be swung counterclockwise. The four-arm link 180 is moved toward main cover 165 by the connecting means 179, while the gap between the first and second yarn guides 194 and 195 is narrowed. As the operating piece 182 touches the thrust piece 167, the cover 165 starts to move about pin 166. While the crank pin 173 is sliding in the arcuate portion of the slot 187 in the lever 175, the base portion of the yarn guide 181 is momentarily halted above the suction hole 164 while holding and guiding the yarn end 10*b*. The yarn end 10*b* then becomes caught or gripped in the suction hole 164 by alignment of the suction hole 164 with the suction opening 163.

The yarn end extending to the yarn draw-out mechanism is then cut by the yarn cutting unit 198 and the yarn end 10*b* connected to the cop is gripped in the suction hole 164 by the vacuum caused thereby. When the crank pin 173 is past the arcuate portion of the slot 187, the lever 175 swings in the opposite direction, and the link 180 is directed away from the section unit 160.

The main cover 165 is now reset automatically by the enclosed spring (not shown), thus closing the suction opening 163. When the yarn guide 181 is at its farthest point from the yarn suction unit 160, the switch 196*d* is turned off by the cam 196*b* operatively associated therewith, and the motor 169 is stopped, so that the yarn guide unit 181 is effectively returned to its initial or starting position.

Figure 2:
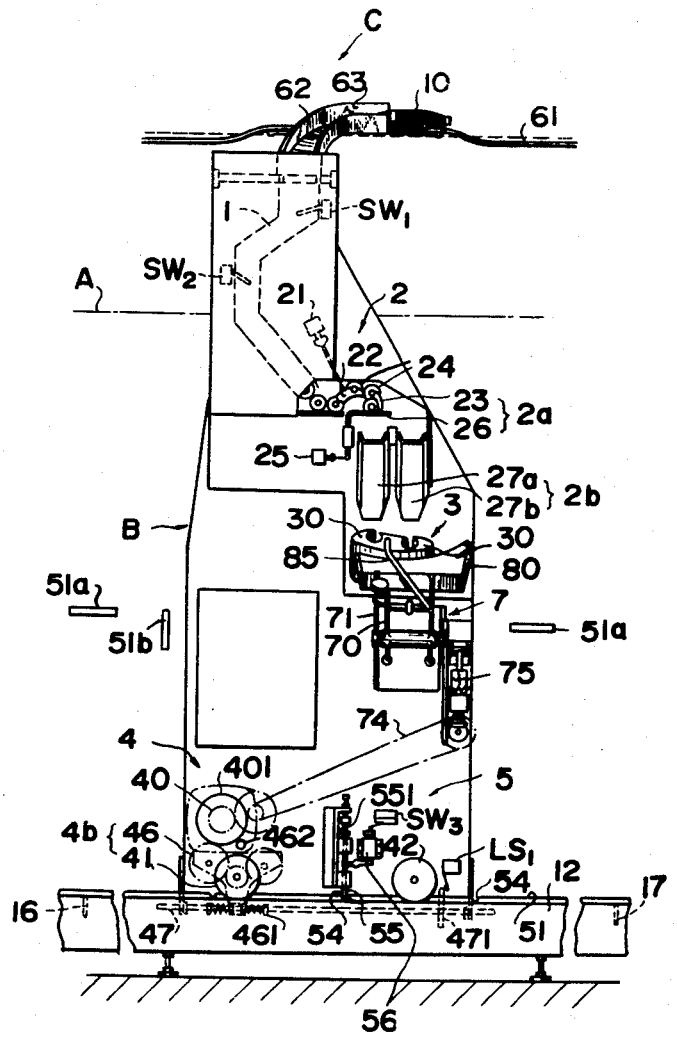
FIG. 2 is a front elevational view of a cop feeder, looking in the direction of the winder and constructed in accordance with the instant invention.

The travelling unit 4*a* depicted in FIGS. 2, 3, and 10 is disposed in the lower part of the cop feeder B and is comprised of a drive roller 41 and a driven roller 42 rolling on a guide rail 12; guide rollers 43 rolling along the sides of rail 12 and a guide roller 44 rolling along guide rail 13 mounted on the side of the winder A. A braking device 45 is provided and is adapted to produce a weak breaking force. The breaking device 45 is mounted on one end of the axle of the drive roller 41, the other end of said axle being connected to a motion-transmitting device 46 by a magnetic clutch 48 to effect driving of the roller 41 by drive unit 40.

The lower part of the cop feeder B is also provided with a changeover unit 4*b* which is designed so that a slidably mounted push rod 47 is engageably mounted with a swingable plate 461 of the motion-transmitting device 46. The ends of rod 47 project from both sides of the cop feeder B to provide for a changeover of the device 46 to effect a reversal of the rotation of the driving roller 41 when stops 16 and 17 are contacted at either end of the winder A at the stroke ends of push rod 47. Alternatively, a changeover switch LS1 is provided in proximity to a flange 471 mounted on a push rod 47. The push rod 47 abuts the stops 16 and 17 at the stroke ends and operates sensor switch $LS_1$, for making a changeover of the travel control circuit and effecting a reversal of the direction of movements of the cop feeder B.

The motion-transmitting device 46 carries a gear train which provides for forward and reverse rotation of the plate 461 with the shaft of drive roller 41 at its center. The gear train is in permanent meshing engagement with the gear of the drive roller 41 and is detachably engaged with the drive gear 401 of the drive unit 40.

The stop position control unit 5 is adapted to stop the cop feeder B when the magazine on the winder A of the charging section 3 of the cop feeder B is precisely aligned with the pocket of the magazine 11. The cop feeder B can thus be precisely stopped to provide cop charging to every other magazine when the feeder B is travelling in one direction and to each intermediate magazine when the cop feeder B is travelling in the opposite direction. To this end, a plurality of positioning pieces may be suitably provided on the machine frame of the winder at the pitch of magazines and the feeder may be provided with an electrical device or a mechanical device for sensing every other signal produced by the positioning pieces. As an alternative embodiment, two different kinds of positioning pieces may be alternately provided on the winder, and two different kinds of sensing means corresponding to the positioning pieces and adapted to be switched over at the stroke ends of the cop feeder may also be provided in the feeder. In the present embodiment, magnetized rectangular positioning pieces 52, consisting of pieces 51*a* and 51*b* are arranged at right angles to each other on the positioning plate 50 of winder A and are disposed in front of the magazine, and reed switches 53 (*ls*A, *ls*B) are mounted on the feeder B at right angles to each other to allow such switches to become operable when they are aligned in orientation with the positioning pieces 51*a* and 51*b*. Switches *ls*A and *ls*B are mounted in series with each other in the stop circuits 94A and 94B of the travel control circuit 94 of the drive section 4 to changeover stop circuit 94 by the operation of the switch LS1 of the switchover mechanism (see FIG. 23).

The stop position control section 5 includes a primary electrical control means adapted for actuating the read switches *ls*A and *ls*B to thereby disconnect the clutch 48 of the drive section 4 when the read switches are aligned with the positioning pieces 52 (51*a* and 51*b*), to thereby cause the feeder B to roll and a secondary mechanical control means is adapted for precisely stopping the travel of the feeder by cooperation with notches 54 on the positioning plate 51 mounted along the rail 12.

The secondary control means includes a detent pin 55 displaceably carried for occasional engagement with notches 54 on the positioning plate 51 when the feeder is a position of registry with each magazine 11 and is kept in pressure contact with the plate 51 by a spring not shown. A solenoid 56 is adapted to forcibly raise the detent pin 55 from the plate 51, and a sensor switch $SW_3$ is adapted to sense the engagement of the detent pin 55 in the notches 54 in the positioning plate 55. Thus, the rolling of the cop feeder B can be completely stopped by engagement of the detent pin 55 with the positioning plate 51.

Figure 23:
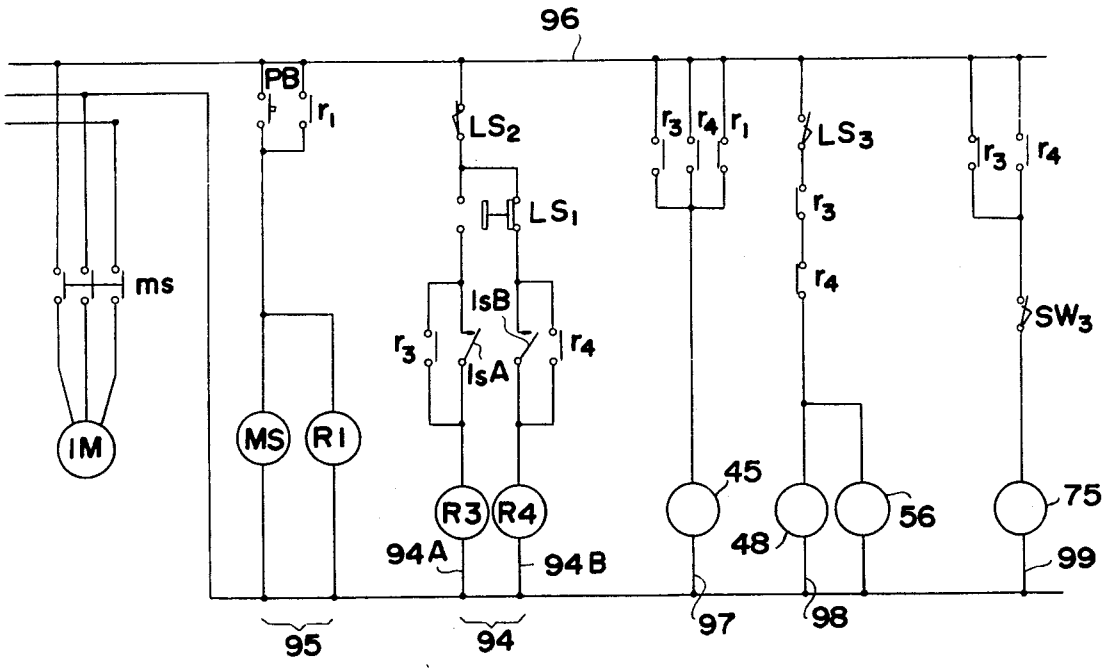
FIG. 23 is a circuit diagram illustrating the electrical circuit adapted to drive the charging section and the lift mechanism of the cop feeder of the instant invention.

An electrical circuit for controlling the travel and operation of the cop feeder is depicted in FIG. 23, in which the reference numerals of the relay contacts represent the relays commonly associated therewith. The drive circuit 95 is arranged so that the magnetic switch MS is turned on by manipulation of a starter push button PB for self-holding the relay R1 and driving the electrical motor 1M of the drive unit 40. The travel control circuit 94 includes two stop circuits 94A and 94B arranged in parallel and adapted to be alternately connected to the electrical source 96 by operation of the switch $LS_1$ of the switchover unit. The operation of the switch $LS_1$ is controlled by microswitches $LS_2$ and $LS_3$ mounted on cams 77 and 78 which are in turn mounted to the end of the control shaft 72 of the lift unit 7. The reed switches *ls*A and *ls*B are operably connected with the positioning pieces 51*a* and 51*b* which are arranged on the winder A and are connected to the stop circuits 94A and 94B in series with the relays R3 and R4. Relays R3 and R4 are adapted to be energized by switches *ls*A and *ls*B respectively. When relay R3 and R4 is conductive, the magnetic braking device 45 connected to the braking circuit 97 becomes operative, and the circuit 98 consisting of a parallel connection of the magnetic clutch 48 of the travel section 4 and the solenoid 56 of the stop position control section 5 is opened. Thus, the solenoid 56 is de-energized and the magnetic clutch 48 is simultaneously disconnected. Thus the detent pin 55 slides on the positioning plate 51 in pressure contact therewith under the force of spring 551 until it snaps into the notch 54 to stop the cop feeder.

The operating circuit 99 of the lift unit 7 is so constructed that, as one of the stop circuits 94A and 94B is in operation, and as the detent pin 55 of the stop position control unit 5 snaps into the notch 54 of the positioning plate 51 causing the feeder B to be halted in the predetermined position, the operating circuit 99 is closed by operation of the sensor switch SW3 of the stop position control section 5. As the operating circuit 99 is closed, the magnetic clutch device 75 of the lift unit 7 becomes operable and the control shaft 72 of the lift unit 7 is set into rotation. Thus, when the cam 77 which is mounted on the shaft 72 makes a full revolution, the charging member 30 is lowered for charging the cop 10 into the magazine 11 and then raised again to its position.

Switches $LS_2$ and $LS_3$ are closed by cams 77 and 78 mounted on the control shaft 72, but the switch LS2 is opened by the control shaft 72 when the shaft is rotated one full revolution, so that the magnetic clutch 75 is disconnected, and the driving force is no longer transmitted to the control shaft 72 and hence to the frame 70. After rolling is achieved for a predetermined time the switch $LS_3$ is closed to complete the travel circuit 98. Thus, the solenoid 56 of the stop position control section 5 is magnetized, and the detent pin 55 is raised from the notch 54 of the positioning plate 51, at the same time that the driving roller is driven into rotation through the magnetic clutch 48 and the travel of the feeder is again started. The switch $LS_2$ is again closed, and the feeder travels as far as the next stop position.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An apparatus for processing yarn ends of cops to be supplied to a plurality of winder units comprising in combination, a magazine associated with each winder unit for receiving said cops, said magazines each including suction means for supplying yarn to the associated winding units; cop feeder means adapted to move along a path including a position in registration with each of said magazines, said cop feeder means including means for stopping said cop feeder means at each of said registration positions, and charging means automatically supplying cops to each of said magazines to dispose same therein when said feeder means is at each said registration position; yarn draw-out means for removing the yarn wound on said cops and drawing out the yarn end; yarn guide means for engaging the yarn extended between said yarn draw-out means and the cop disposed in said magazine to guide the yarn into proximity with said magazine suction means; and yarn cutting means for cutting the yarn gripped by said suction means in a position intermediate said suction means and said yarn draw-out means.

2. An apparatus for processing yarn ends of cops as recited in claim 1, wherein each of said plurality of magazines includes at least two cavities for receiving said cops, said cavities being peripherally disposed around said magazine.

3. An apparatus for processing yarn ends of cops as recited in claim 2, wherein said suction means includes a suction opening centrally disposed with respect to said magazine cavities and said suction means further includes vacuum discharge means for applying suction pressure at said suction opening for feeding the yarn gripped thereby to said winding unit.

4. An apparatus for processing yarn ends of cops as recited in claim 1, wherein said yarn suction means is mounted substantially at the center of each winder magazine and is adapted to hold a yarn end by suction, said winder magazine including a vacuum opening said vacuum opening including a cover displaceable in a first and second position, said first position keeping closed the opening of said yarn suction means, said yarn guide means including abutment means said abutment means being adapted to engage said cover and displace said cover to its second position when said guide means guides the yarn end toward said suction means.

5. An apparatus for processing yarn ends of cops as recited in claim 1, wherein said cop feeder includes a travelling unit for driving said cop feeder, said travelling unit including a drive roller and a driven roller; and said winder units including rails; said rails supporting said rollers to allow said cop feeder to be moved therealong.

6. An apparatus for processing yarn ends of cops as recited in claim 5, wherein said cop feeder also includes a changeover unit, said changeover unit including means for reversing the rotation of the driving roller to thereby effect a change in the direction of movement of said cop feeder.

7. An apparatus for processing yarn ends of cops as recited in claim 1, wherein said charging means includes a charging member for receiving, holding and supplying said cops and cop charging control means for sensing the presence of a cop in the said charging member, and upon the failure to sense such presence, being adapted to selectively insert a cop into said charging member.

8. An apparatus for processing yarn ends of cops as recited in claim 1, wherein said charging means includes a charging member for receiving, holding and supplying said cops and lift means for displacing said charging member between a cop receiving position and a cop charging position; said cop charging position being in registration with said magazine.

9. An apparatus for processing yarn ends of cops as recited in claim 8, wherein said charging member includes at least two longitudinal cop-receiving apertures therethrough.

10. An apparatus for processing yarn ends of cops as recited in claim 9, wherein each of said cavities have cover plates pivotally mounted to the lower end of said cop-receiving apertures, said cover plates being releasably positioned to close said apertures until it is desired to selectively open the same for selectively delivering said cop into said magazine.

11. An apparatus for processing yarn ends of cops as recited in claim 10, wherein said cover plate includes charging control means for selectively releasing said cover plate to selectively open said cavity, said charging control means including a boss disposed on each of said cover plates, a detent lever pivotally mounted at a first end to said charging member and engageable with said boss in a first position to keep said cover plate in a closed position, and sensing means for sensing the position of said charging member and effecting a disengagement of said detent lever with said boss when said charging member is in the cop charging position to allow said cover plate to be opened by the weight of the cop contained in said cavity.

12. An apparatus for processing yarn ends of cops recited in claim 1, wherein the yarn ends of said cops are bunch wound at the end thereof said yarn draw-out means includes a main body engaging said cop at the end thereof having said bunch winding, vacuum means in fluid connection with said main body for providing suction thereto, and means for removing said bunch winding so that the free end of said bunch winding is directed toward said vacuum means.

13. An apparatus for processing yarn ends of cops as recited in claim 12, wherein said removing means includes air supply means coupled to said main body and adapted to supply compressed air to said body, said compressed air effecting a removing of said bunch winding to thereby free the end of said yarn and direct said free end to said vacuum means.

14. An apparatus for processing yarn ends of cops as recited in claim 13, wherein said main body is formed of a cylinder having a bottom wall and an open end into which said cop end is inserted, said vacuum means being coupled in proximity to the closed end of said cylinder and said air supply unit being coupled to said cylinder proximate said open end.

15. An apparatus for processing yarn ends of cops as recited in claim 14, wherein the open end of said main body includes a rim defining a recessed portion for providing an opening for receiving ambient air in said main body when said body has said cop inserted therein.

16. An apparatus for processing yarn ends of cops as recited in claim 14, wherein said air supply means includes air supply passages aligned in a truncated conical array, the outlets of said passages defining the base of smaller diameter of said array and directing said air to said bunch winding.

17. An apparatus for processing yarn ends of cops as recited in claim 1, wherein the cutting means is mounted so that a cutting edge thereof is located on a straight line connecting the yarn draw-out means and said magazine suction means whereby the yarn may be cut at the same time as the yarn end is guided to and gripped by said suction means.

18. An apparatus for processing yarn ends of cops as recited in claim 1, wherein said yarn draw-out means is positioned above said charging means for acting on said cops before their charging into said magazine, said yarn guide means including first guide means positioned intermediate said charging means and said magazine and second guide means coordinately operable with said first guide means positioned intermediate said yarn draw-out means and said charging means.

19. An apparatus for processing yarn ends of cops as recited in claim 18, wherein said second guide means includes means for permitting the independent operation of said first guide means if a cop in said charging means prevents the operation of said second guide means.

20. An apparatus for processing yarn ends of cops as recited in claim 1, wherein said yarn draw-out means remove the yarn wound on said cops when said cops are disposed in said magazine.

21. An apparatus for processing yarn ends of cops as recited in claim 1, wherein said yarn draw-out means effects removing of the yarn wound on said cops when said cops are disposed in said charging means.

* * * * *